US009669442B1

(12) United States Patent
Alvarez

(10) Patent No.: US 9,669,442 B1
(45) Date of Patent: Jun. 6, 2017

(54) DENT REMOVING APPARATUS

(71) Applicant: Jose Cruz Alvarez, Denton, TX (US)

(72) Inventor: Jose Cruz Alvarez, Denton, TX (US)

( * ) Notice: Subject to any disclaimer, the term of this patent is extended or adjusted under 35 U.S.C. 154(b) by 0 days.

(21) Appl. No.: 15/376,198

(22) Filed: Dec. 12, 2016

Related U.S. Application Data

(60) Provisional application No. 62/266,106, filed on Dec. 11, 2015.

(51) Int. Cl.

| | |
|---|---|
| ***F04B 37/14*** | (2006.01) |
| ***B21D 1/06*** | (2006.01) |
| ***B21D 53/88*** | (2006.01) |
| ***B25B 11/00*** | (2006.01) |
| ***F04B 33/00*** | (2006.01) |

(52) U.S. Cl.
CPC ..... *B21D 1/06* (2013.01); *B21D 53/88* (2013.01); *B25B 11/007* (2013.01); *F04B 33/00* (2013.01); *F04B 37/14* (2013.01)

(58) Field of Classification Search
CPC ..... F04B 37/14; F04B 11/007; B25B 11/007; B21D 1/06; B21D 53/88
USPC ..... 72/457
See application file for complete search history.

(56) References Cited

U.S. PATENT DOCUMENTS

| | | | | |
|---|---|---|---|---|
| 3,728,891 | A * | 4/1973 | Hall, Jr. | B21D 1/06 72/479 |
| 4,753,104 | A * | 6/1988 | Strozier | B21D 1/06 72/457 |
| 6,536,250 | B1 * | 3/2003 | Borchert | B21D 1/06 72/37 |
| 7,430,891 | B1 * | 10/2008 | Wang | B21D 1/06 72/453.01 |
| 8,418,522 | B1 * | 4/2013 | Liao | B21D 1/06 72/457 |
| 8,651,458 | B2 * | 2/2014 | Liao | B25B 11/007 254/133 R |
| 9,441,622 | B2 * | 9/2016 | Liao | F04B 37/14 |

* cited by examiner

*Primary Examiner* — David B Jones

(57) ABSTRACT

A dent removing apparatus that utilizes piston technology along with the magnetism to remove dents includes a handle, a linear actuator, an interchangeable suction cup, and an interchangeable magnetized base. The handle allows the user to grasp the apparatus while the interchangeable magnetized base engages with the dent. A magnetized bottom rim of the interchangeable suction cup perimetrically positions around the dent and the interchangeable magnetized base and engaged with the surrounding surface area of the dent. Then the dent can be pulled or push to be even with the surrounding surface area through the linear actuator as the linear actuator can be manually, pneumatically, or electrically operated.

13 Claims, 17 Drawing Sheets

DENT REMOVING APPARATUS

The current application claims a priority to the U.S. Provisional Patent application Ser. No. 62/266,106 filed on Dec. 11, 2015. The current application is filed on Dec. 12, 2016 while Dec. 11, 2016 was on a weekend.

FIELD OF THE INVENTION

The present invention relates generally to an apparatus for sheet metal repair. More specifically, the present invention is dent removing apparatus that uses piston technology along with magnetism to remove dents, while reducing labor cost.

BACKGROUND OF THE INVENTION

Paintless dent repair is method or removing minor dents and dinks from the body of a motor vehicle. A wide range of repairs can be done to aluminum and steel panel through the paintless dent repair method as long as the paint surface is intact. Preferably, a metal rod and body picks are utilized within the paintless dent repair method to push out the dents from the underside of the body panel. However, when the existing paint is damaged within the dent, other dent removing tools and method are used to repair the dent. Main problem with the existing methods that they can be a time consuming process, often time resulting higher labor costs.

It is an objective of the present invention to provide a dent removing apparatus that uses piston technology along with magnetism to remove dents, while cutting down labor time and physical labor. The present invention allows the users to fix the dent without disassembling or puncturing the surface area being fixed while enabling a paintless dent repair method.

DETAIL DESCRIPTIONS OF THE INVENTION

All illustrations of the drawings are for the purpose of describing selected versions of the present invention and are not intended to limit the scope of the present invention.

The present invention is a dent removing apparatus that uses piston 19 technology along with magnetism to remove dents, while cutting down labor time, physical labor, and completing a paint-less dent removal process. The present invention creates suction force along with magnetic force to pull or push dents even with the surrounding surface. The suction force can be generated with verity of different actuating methods as some of the components of the present invention changes according to the respective actuating method. More specifically, the present invention can be manually, pneumatically, and electrically actuated to complete a dent removal process. The present invention removes dinks and dents without having to puncture, cosmetically change, damage, or disassemble the object being worked on while maximizing the efficiency of the dent removal process. Furthermore, the present invention functions as a portable handheld apparatus to reduce time between multiple damaged surface areas as the user can easily move from one damaged surface area to another.

Figure 1:
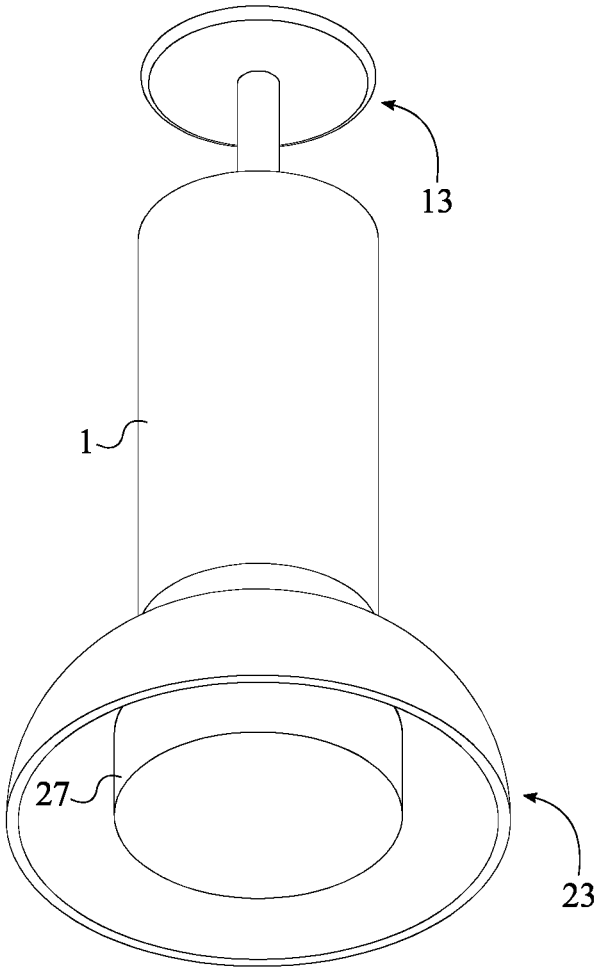
FIG. 1 is a bottom perspective view of the first embodiment of the present invention.
Figure 2:
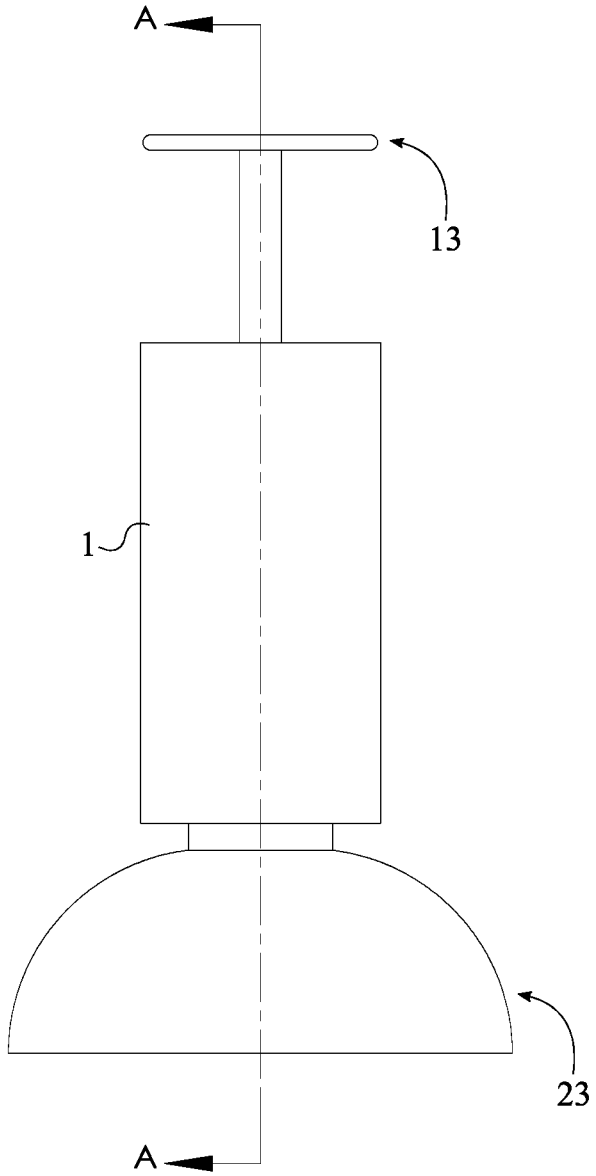
FIG. 2 is a front view of the first embodiment, showing the plane upon which a cross sectional view is taken shown in FIG. 3.
Figure 3:
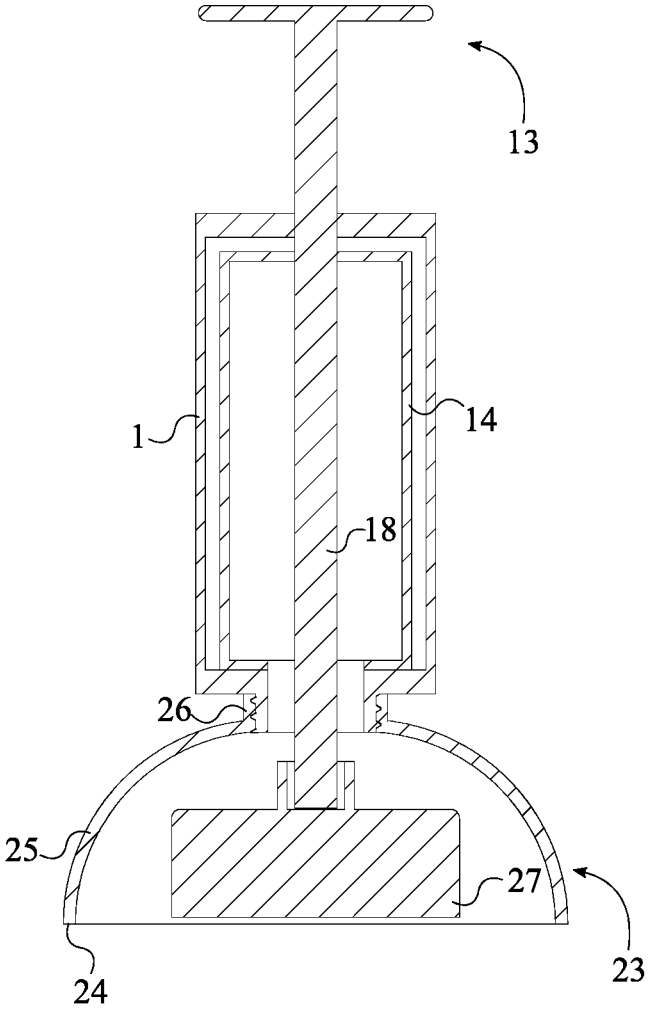
FIG. 3 is a cross section view of the first embodiment taken along line A-A of FIG. 2.
Figure 17:
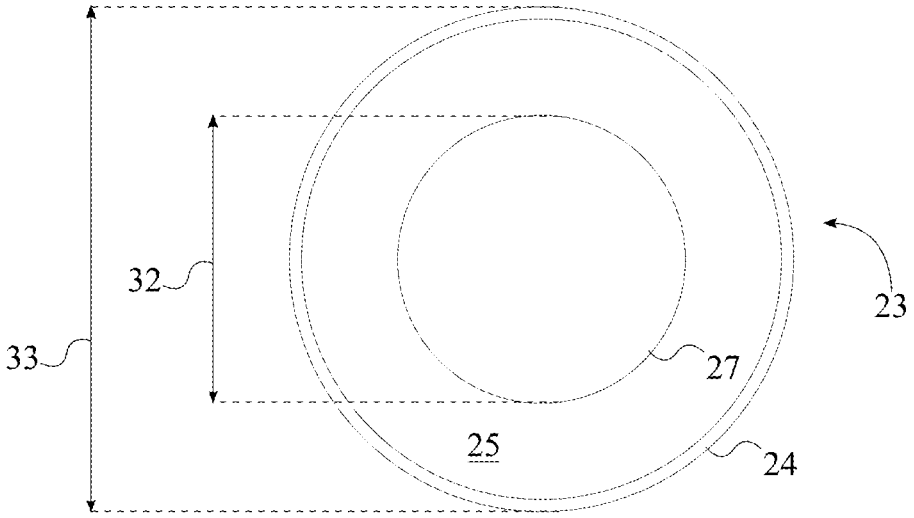
FIG. 17 is a bottom view of the present invention showing the diameter difference between the interchangeable magnetized base and the interchangeable suction cup.

The present invention comprises a handle 1, a linear actuator 13, an interchangeable suction cup 23, and an interchangeable magnetized base 27 as the primary components. A first embodiment of the present invention is a manually operated dent removing apparatus and shown in FIG. 1-3. More specifically, an actuator base 14 of the linear actuator 13 is internally connected to the handle 1 while an output rod 18 of the linear actuator 13 is telescopically engaged to the actuator base 14. the handle 1 functions as the gripping member of the present invention so that the user is able to firmly grasp the handle 1 from one hand while allowing the other hand to operate the present invention. When the present invention is operational, the output rod 18 traverses through the handle 1 selectively performing a forward motion or a backward motion. The interchangeable magnetized base 27 and the interchangeable suction cup 23 are externally positioned to the handle 1. The interchangeable magnetized base 27 is concentrically and terminally mounted to the output rod 18 so that the interchangeable magnetized base 27 is also able to move in the forward direction or the backward direction along with the output rod 18. The interchangeable magnetized base 27 functions as the intermediary member between the present invention and the damaged surface area so that the magnetic force of the interchangeable magnetized base 27 can attach the present invention to the damaged surface area. The interchangeable suction cup 23 is externally connected to the handle 1 and concentrically positioned around the interchangeable magnetized base 27. More specifically, the interchangeable suction cup 23 comprises a magnetized bottom rim 24, a lateral wall 25, and an upper rim 26. The upper rim 26 is removably attached to the handle 1 while the magnetized bottom rim 24 is oppositely positioned of the upper rim 26, along the lateral wall 25. The interchangeable suction cup 23 functions as a hermetic enclosure for the damaged surface area as the magnetized bottom rim 24 hermetically and perimetrically seals around the damaged surface area. In reference to FIG. 17, a diameter 32 of the interchangeable magnetized base 27 is configured to be smaller than a diameter 33 of the interchangeable suction cup 23 so that the interchangeable magnetized base 27 is able to move in the forward direction or the backward direction without interfering with the interchangeable suction cup 23.

The present invention further comprises an inlet port 4, a control system 7, a directional switch 2, and a control switch 3. More specifically, the inlet port 4 traverses into the handle 1 and operatively coupled with the control system 7 as the control system 7 is internally connected to the handle 1. The inlet port 4 can be a pneumatic inlet to receive compressed air or an electrical inlet to receive electricity. The directional switch 2 and the control switch 3 that are integrated into the handle 1 is operatively coupled to the actuator base 14 through the control system 7 to control the actuating method. Since compressed air and electricity require different control system 7*s* to complete the actuating method, respective actuating methods are explained in relation to the following embodiments hereinafter.

Figure 4:
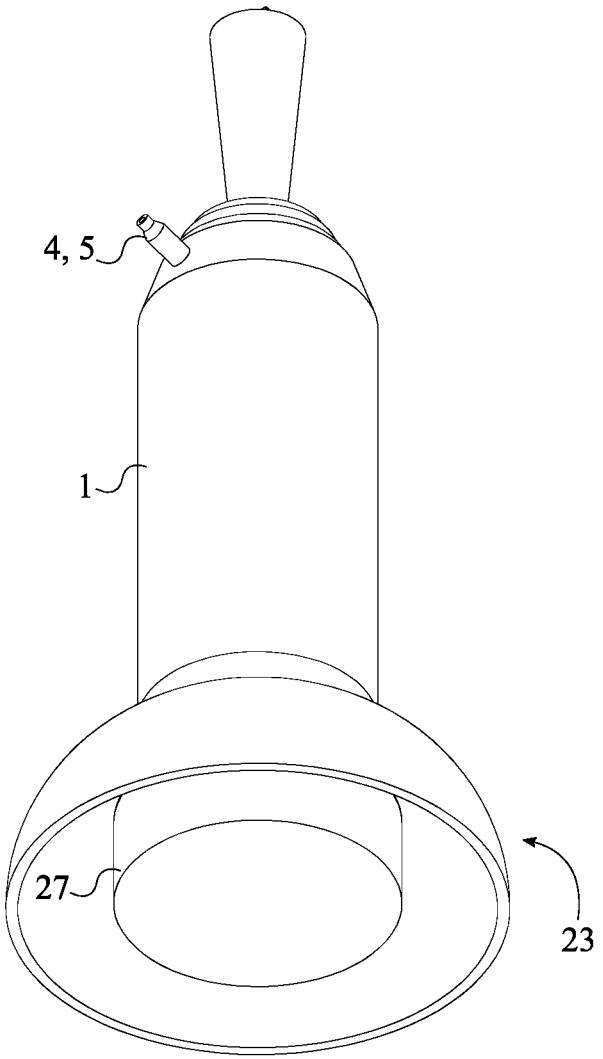
FIG. 4 is a bottom perspective view of the second and third embodiments of the present invention.
Figure 5:
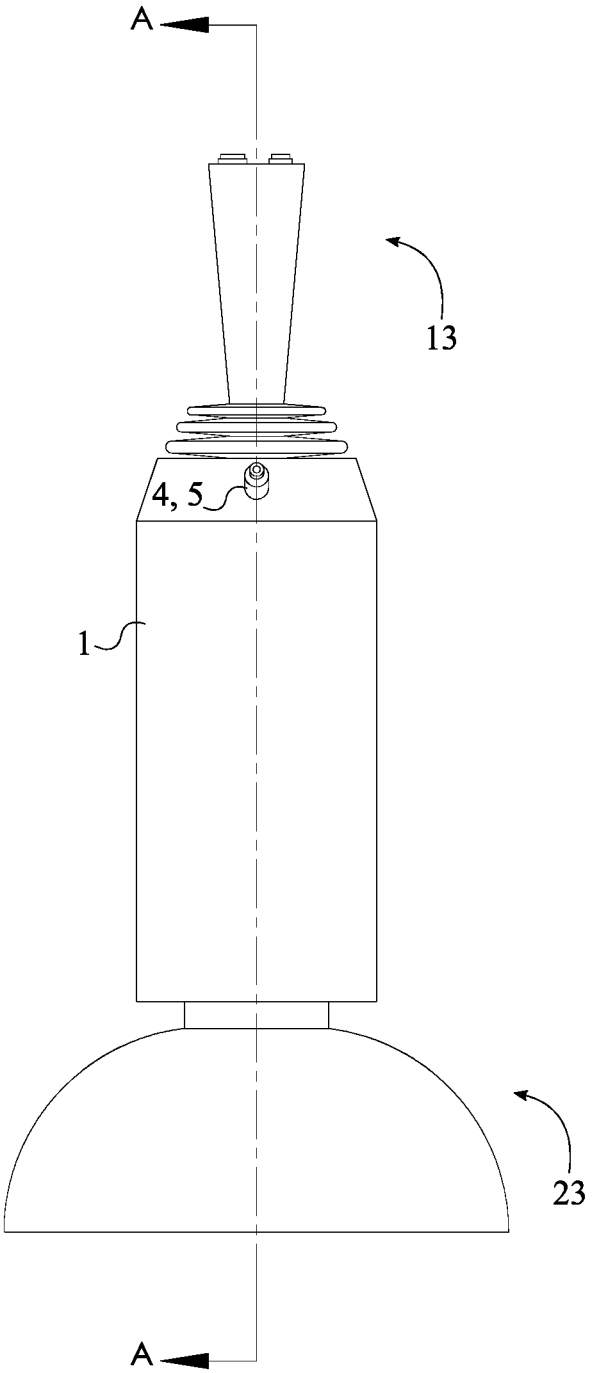
FIG. 5 is a front view of the second and third embodiments, showing the plane upon which a cross sectional view is taken shown in FIG. 6 and FIG. 9.
Figure 6:
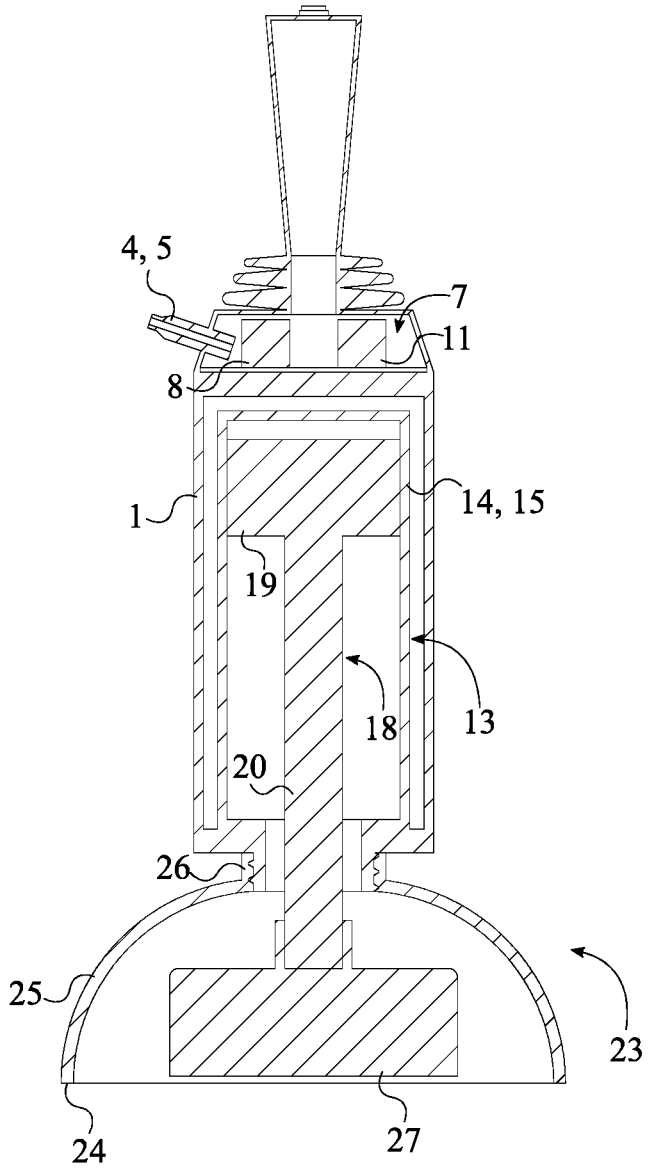
FIG. 6 is a cross section view of the second embodiment taken along line A-A of FIG. 5.
Figure 7:
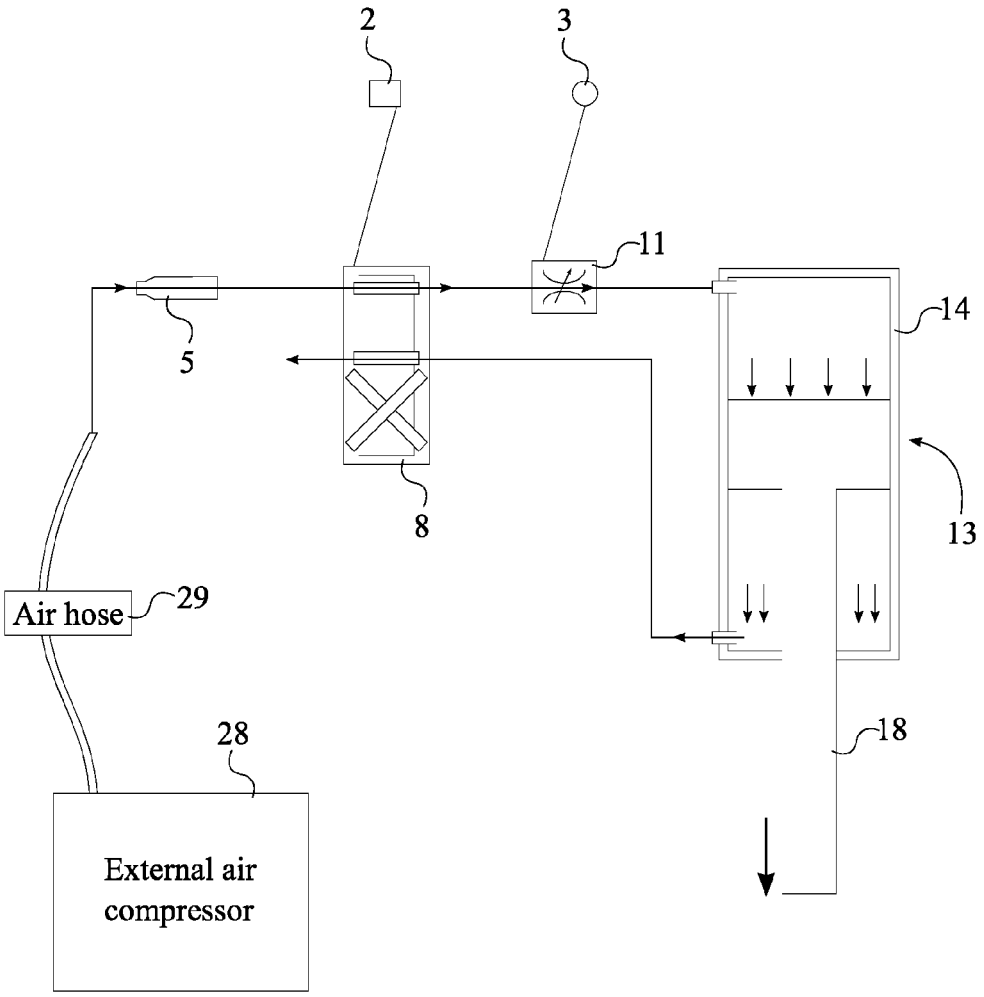
FIG. 7 is a basic schematic view of the second embodiment showing the in fluid communications, wherein the output rod moves in the forward direction.
Figure 8:
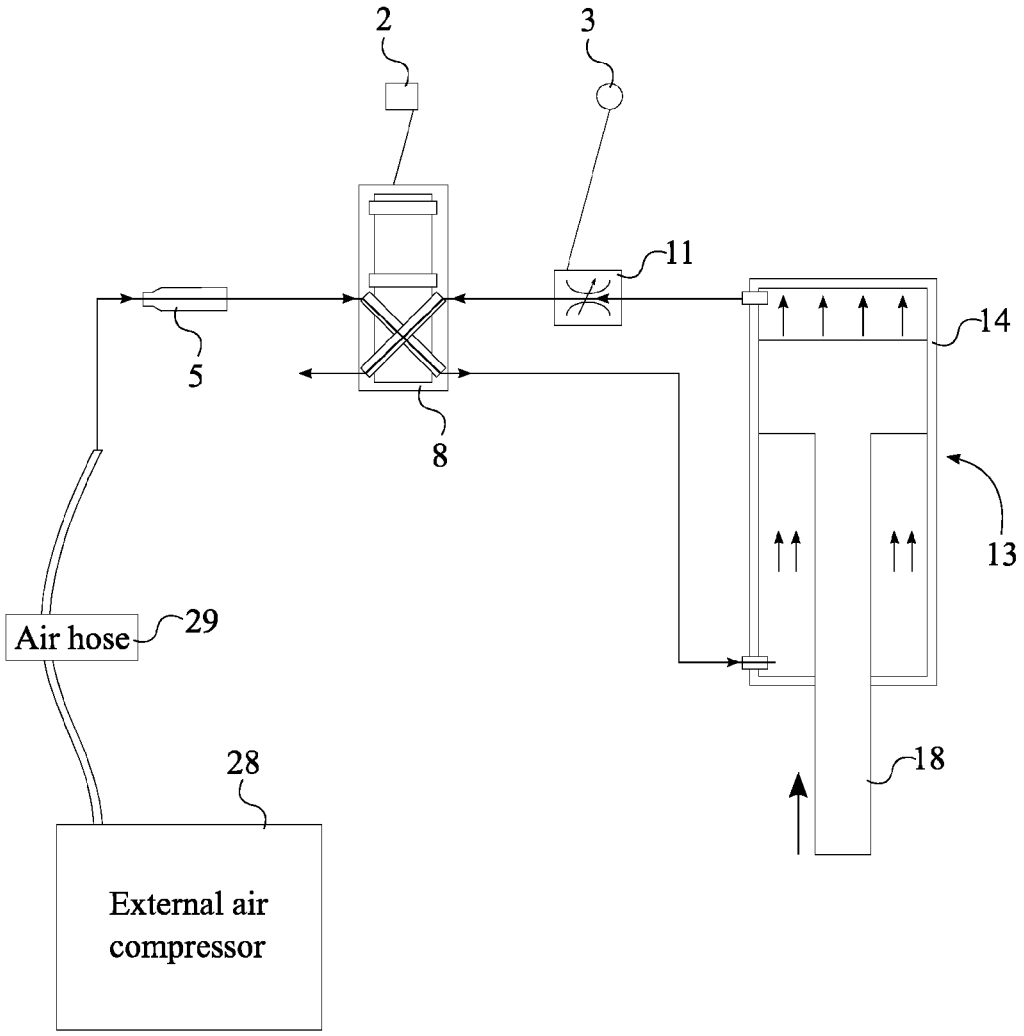
FIG. 8 is a basic schematic view of the second embodiment showing the in fluid communications, wherein the output rod moves in the backward direction.

A second embodiment of the present invention is a pneumatically operated dent removing apparatus and shown in FIG. 4-6. More specifically, the inlet port 4 is formed into an air inlet 5 thus allowing an external air compressor 28 unit to be in fluid communication with the air inlet 5 through an air hose 29. The control system 7 comprises a directional control valve 8 and a flow control valve 11 as the air inlet 5 is in fluid communication with the directional control valve 8. In reference to FIG. 7-8, the directional control valve 8, which determines the directional flow of compressed air within the second embodiment, is in fluid communication with the flow control valve 11 and mechanically coupled to the directional switch 2. As a result, the user is able to selectively move the output rod 18 in the forward direction or the backward direction through the operation of the directional switch 2 which simultaneously controls the directional control valve 8. In reference to FIG. 7-8, the flow control valve 11, which determines the applied pressure force of the output rod 18 within the second embodiment, is in fluid communication with the actuator base 14 and mechanically coupled with the control switch 3. As a result, the user is able to control the amount of pressure applied to the output rod 18 when the output rod 18 moves in the forward direction or the backward direction through the operation of the control switch 3 which simultaneously controls the flow control valve 11.

Figure 9:
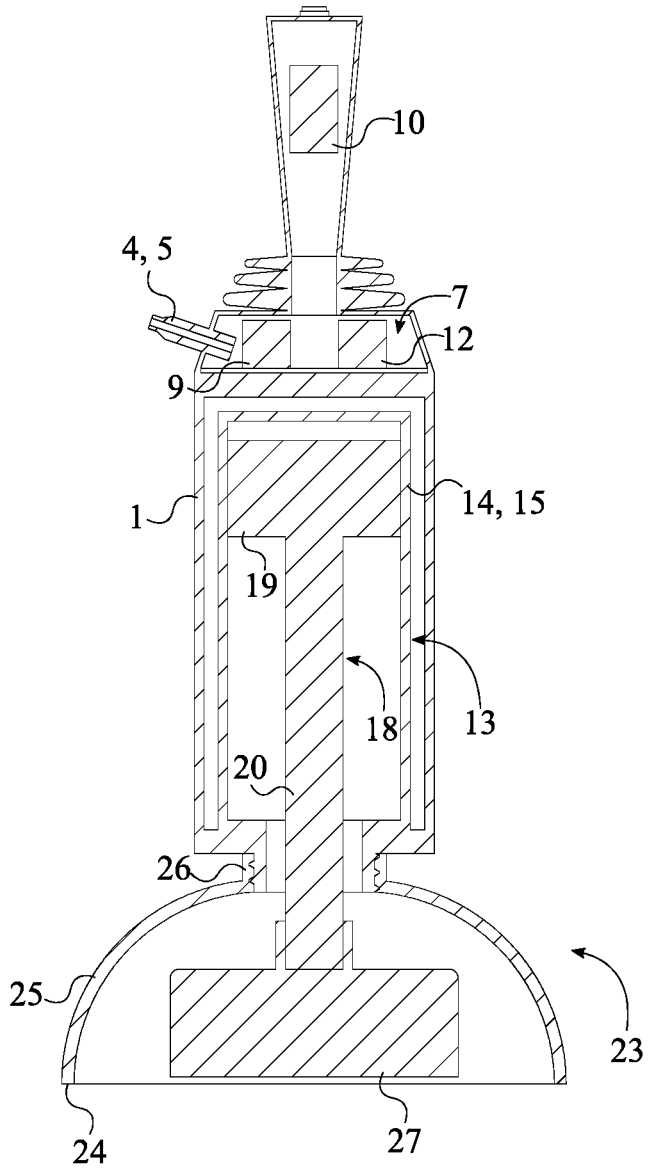
FIG. 9 is a cross section view of the third embodiment taken along line A-A of FIG. 5.
Figure 10:
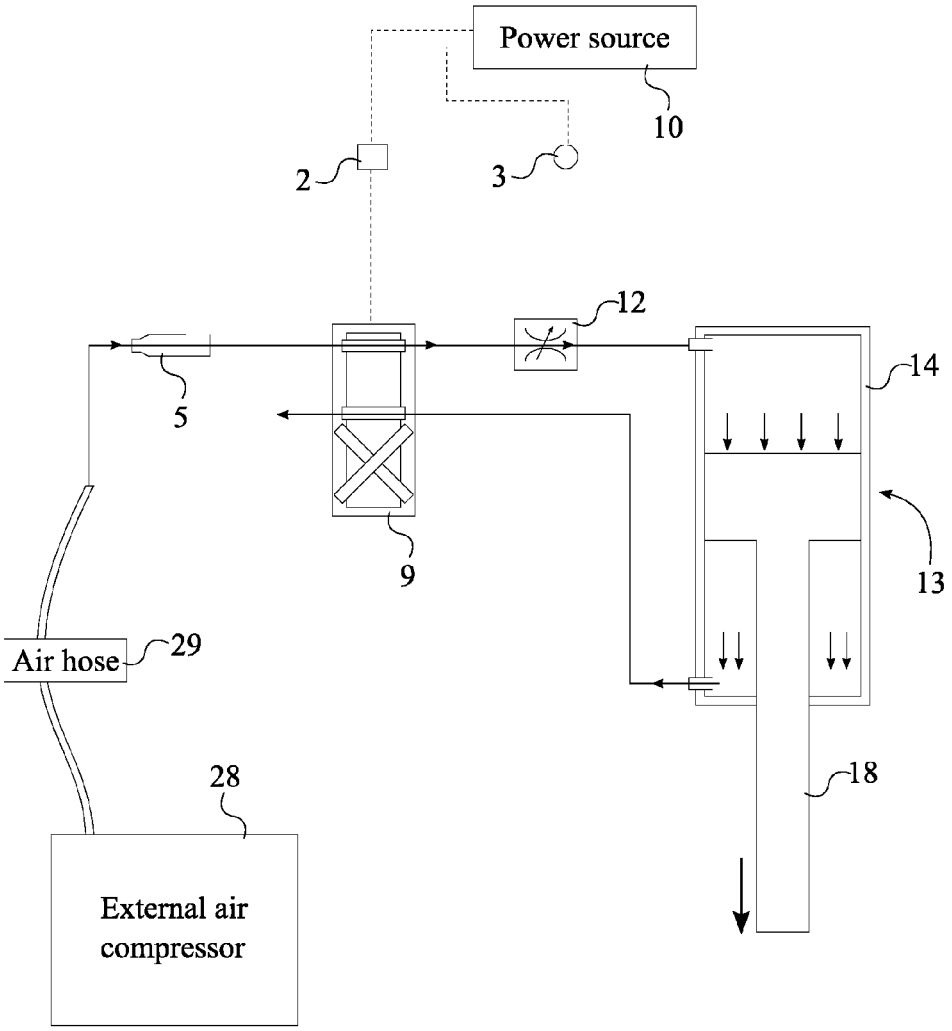
FIG. 10 is a basic schematic view of the third embodiment showing the in fluid communications and the electrical connections, wherein the output rod moves in the forward direction.
Figure 11:
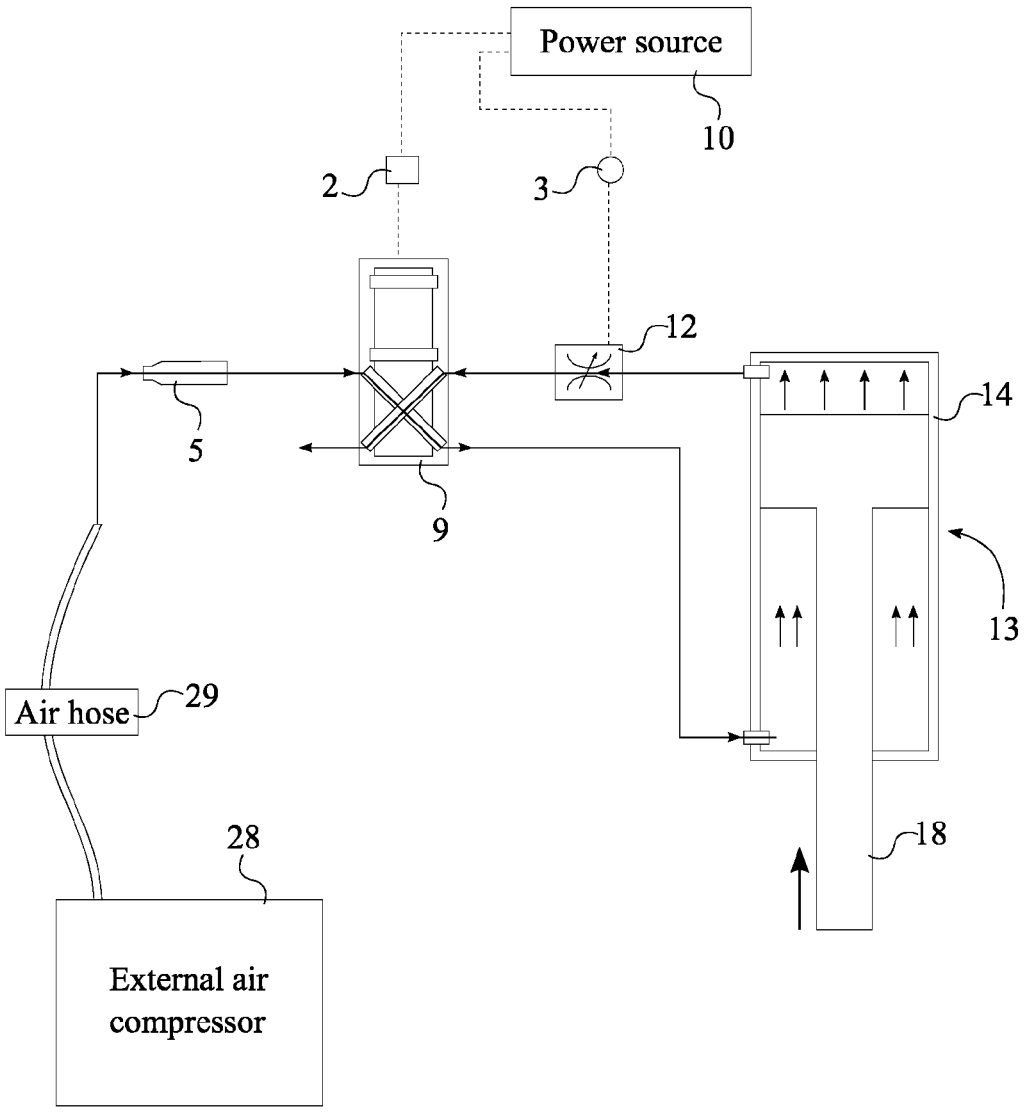
FIG. 11 is a basic schematic view of the third embodiment showing the in fluid communications and the electrical connections, wherein the output rod moves in the backward direction.

A third embodiment of the present invention is a pneumatically operated dent removing apparatus and shown in FIGS. 4, 5, and 9. More specifically, the inlet port 4 is formed into an air inlet 5 thus allowing an external air compressor 28 unit to be in fluid communication with the air inlet 5 through an air hose 29. The control system 7 comprises a directional control solenoid 9, a flow control solenoid 12, and a power source 10 as the air inlet 5 is in fluid communication with the directional control solenoid 9. In reference to FIG. 10-11, the directional control solenoid 9, which determines the directional flow of compressed air within the third embodiment, is in fluid communication with the flow control solenoid 12. The directional switch 2 is electrically connected to the directional control solenoid 9 through the power source 10 as both the directional switch 2 and the directional control solenoid 9 are electrically powered through the power source 10. As a result, the user is able to selectively move the output rod 18 in the forward direction or the backward direction through the operation of the directional switch 2 which simultaneously controls the directional control solenoid 9. In reference to FIG. 10-11, the flow control solenoid 12, which determines the applied pressure force of the output rod 18 within the third embodiment, is in fluid communication with the actuator base 14. The control switch 3 is electrically connected to the flow control solenoid 12 through the power source 10 as both the directional switch 2 and the flow control solenoid 12 are electrically powered through the power source 10. As a result, the user is able to determine the amount of pressure applied to the output rod 18 when the output rod 18 moves in the forward direction or the backward direction through the operation of the control switch 3 which simultaneously controls the flow control solenoid 12.

In reference to the second and third embodiments of the present invention, the actuator base 14 is a cylinder housing 15, and the output rod 18 comprises a piston 19 and a piston rod 20 as shown in FIG. 6 and FIG. 9. More specifically, the piston 19 is concentrically positioned and terminally connected to the piston rod 20. The piston 19 is telescopically interfitted within the cylinder housing 15 so that the piston rod 20 is able to traverse through the cylinder housing 15 and the handle 1 to selectively move the piston rod 20 in the forward direction or the backward direction.

Figure 12:
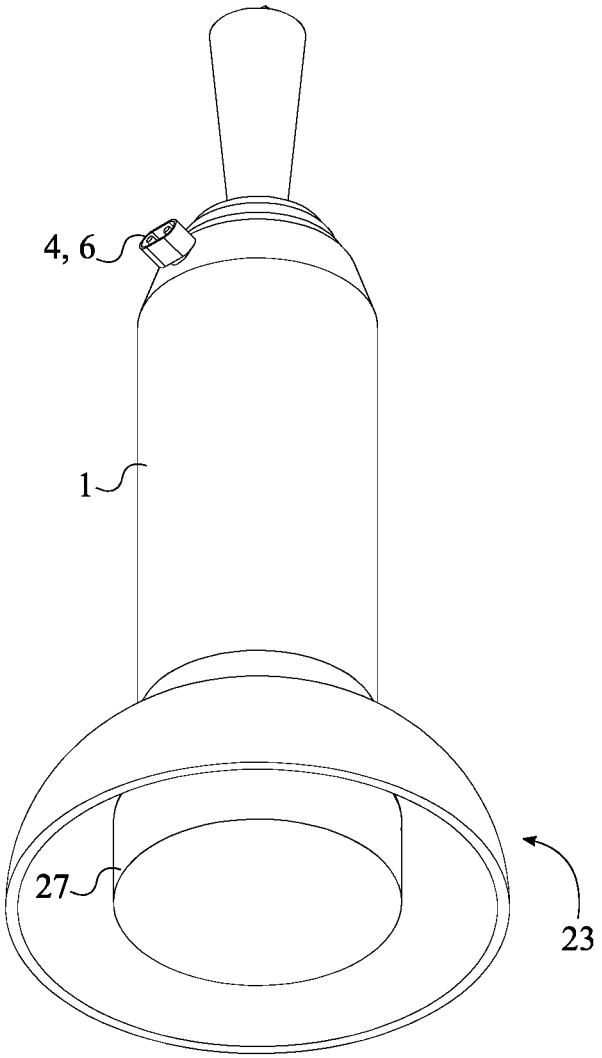
FIG. 12 is a bottom perspective view of the fourth embodiment of the present invention.
Figure 13:
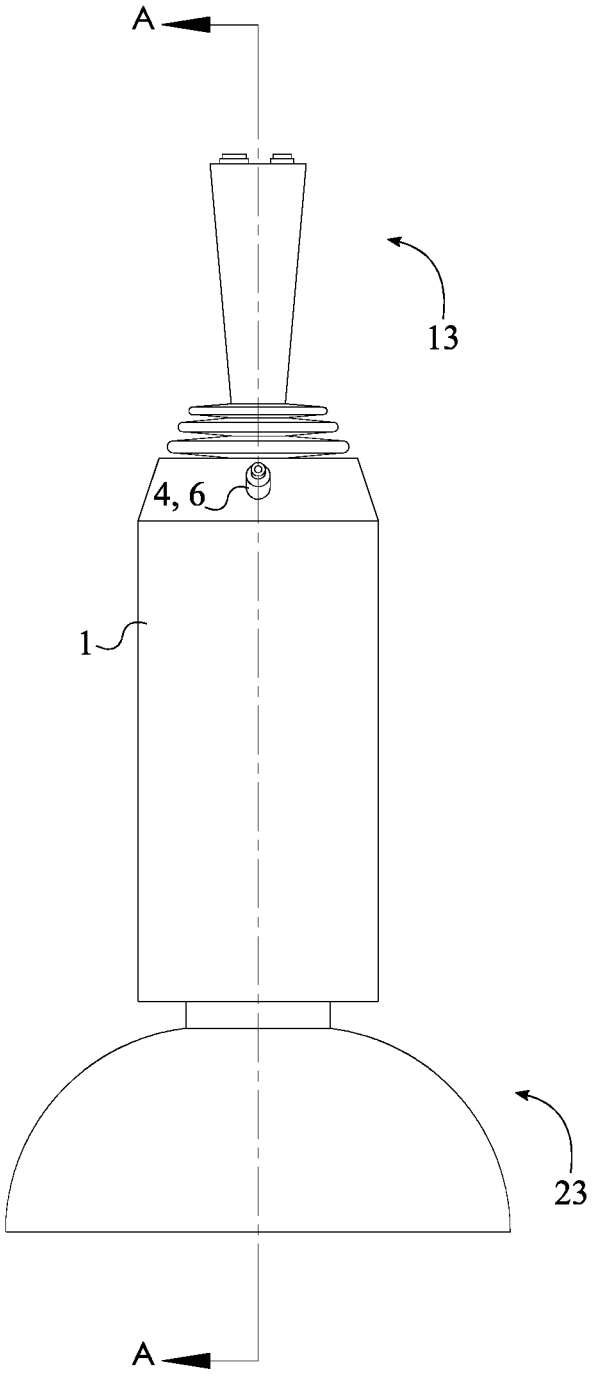
FIG. 13 is a front view of the fourth embodiment, showing the plane upon which a cross sectional view is taken shown in FIG. 14.
Figure 14:
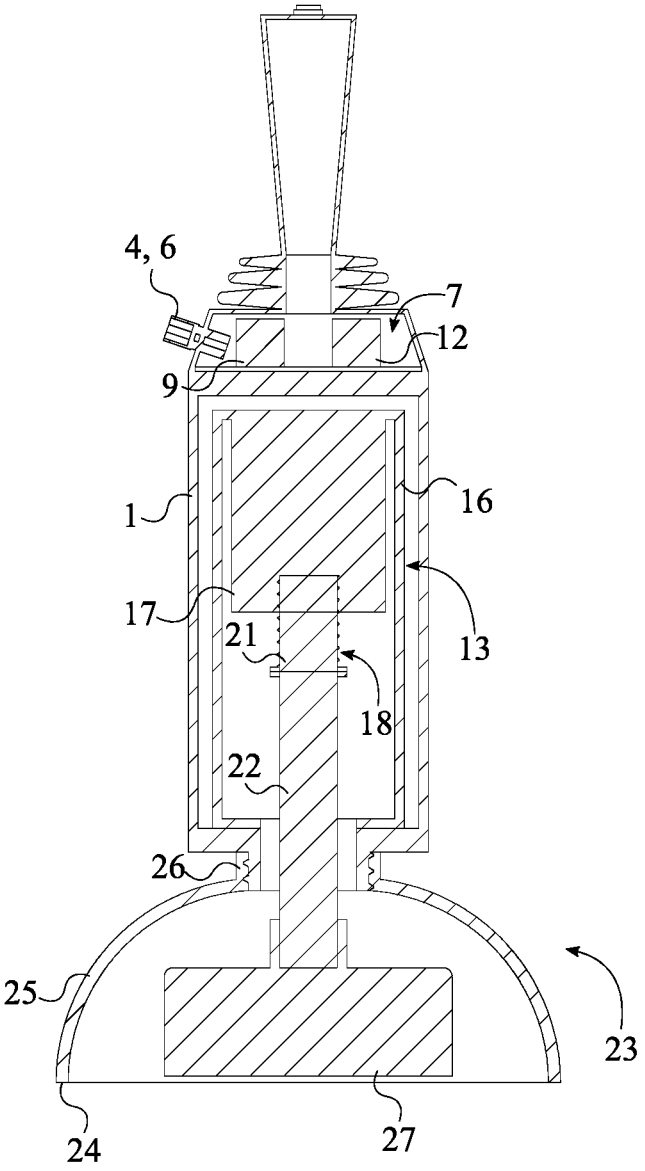
FIG. 14 is a cross section view of the fourth embodiment taken along line A-A of FIG. 13.
Figure 15:
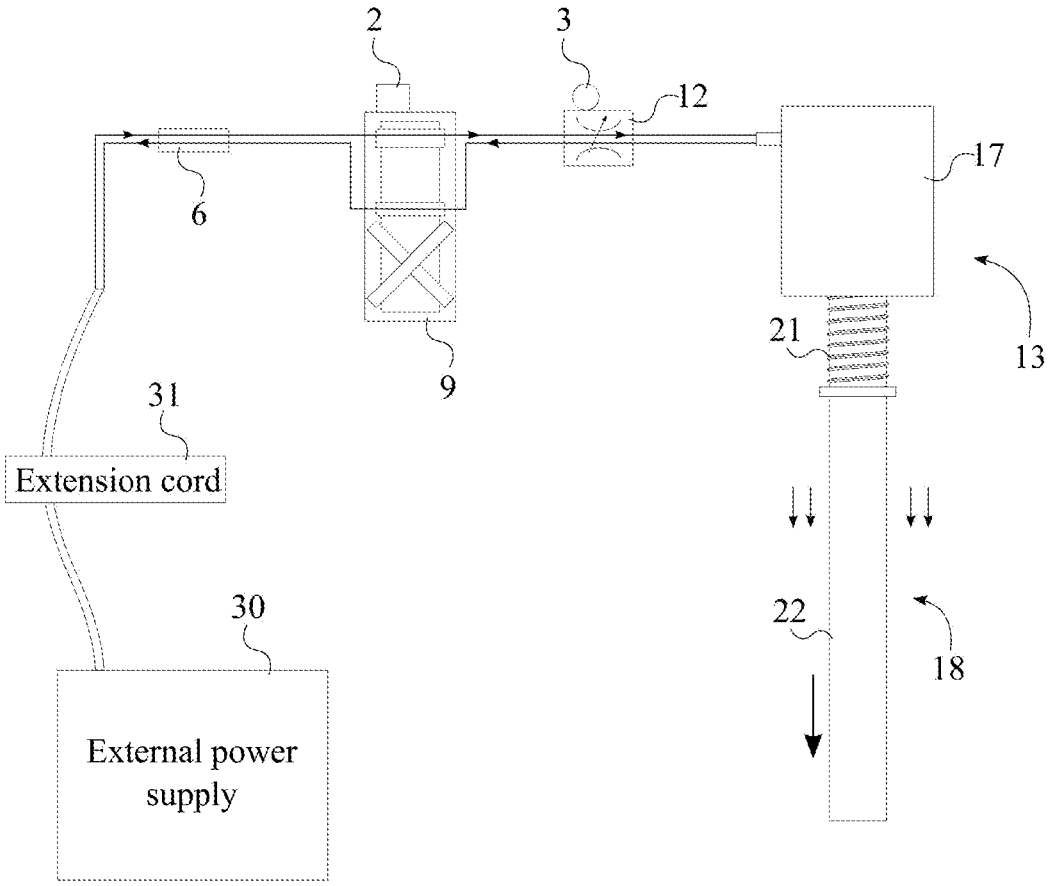
FIG. 15 is a basic schematic view of the fourth embodiment showing the electrical connections, wherein the output rod moves in the forward direction.
Figure 16:
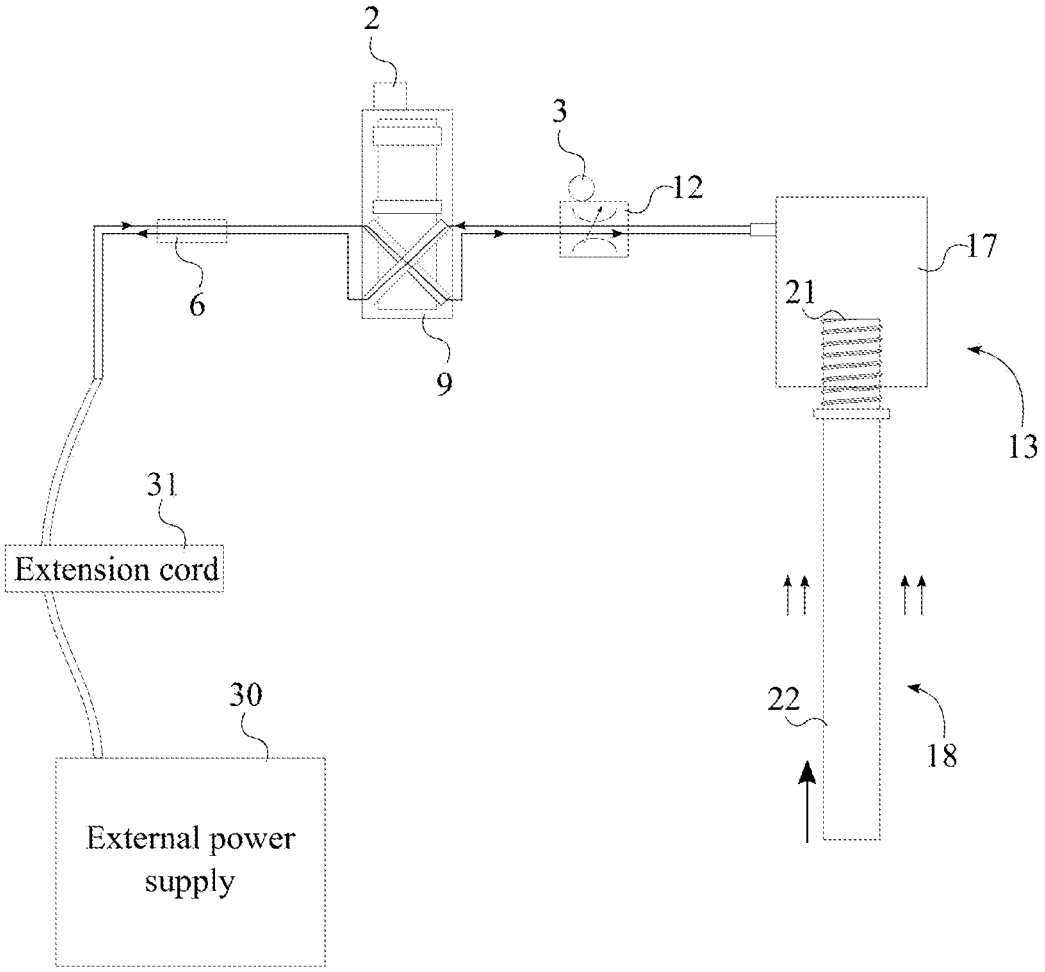
FIG. 16 is a basic schematic view of the fourth embodiment showing the electrical connections, wherein the output rod moves in the backward direction.

A fourth embodiment of the present invention is an electrically operated dent removing apparatus and shown in FIG. 12-14. More specifically, the inlet port 4 is formed into an electrical connector 6 thus allowing an external power supply 30 unit to be electrically connected with the electrical connector 6 through an extension cord 31. Furthermore, the directional control solenoid 9 and the flow control solenoid 12 are electrically connected to the actuator base 14. The control system 7 comprises a directional control solenoid 9 and a flow control solenoid 12. In reference to FIG. 15-16, the directional control solenoid 9, which determines the directional flow of electrical current within the fourth embodiment, is electrically connected to the directional switch 2 and the electrical connector 6. As a result, the user is able to selectively move the output rod 18 in the forward direction or the backward direction through the operation of the directional switch 2 which simultaneously controls the directional control solenoid 9. In reference to FIG. 15-16, the flow control solenoid 12, which determines the applied pressure force of the output rod 18 within the fourth embodiment, is electrically connected to the control switch 3 and the electrical connector 6. As a result, the user is able to determine the amount of pressure applied to the output rod 18 when the output rod 18 moves in the forward direction or the backward direction through the operation of the control switch 3 which simultaneously controls the flow control solenoid 12.

In reference to the fourth embodiments of the present invention, the actuator base 14 comprises a tubular housing 16 and an in-line motor 17 while the output rod 18 comprises a spindle 21 and a driving rod 22 as shown in FIG. 14. More specifically, the in-line motor 17 that applies rotational motion to the spindle 21 is concentrically mounted within the tubular housing 16. The spindle 21 is rotatably engaged to the in-line motor 17 while the driving rod 22 is concentrically engaged to the spindle 21, opposite of the in-line motor 17. As a result, the spindle 21 is able to convert rotational motion from the in-line motor 17 to linear motion so that the driving rod 22 is able to traverse through the cylinder housing 15 and the handle 1 to selectively move the driving rod 22 in the forward direction or the backward direction.

Optionally, the present invention can further comprise a limit switch to automatically stop the forward motion or the backward motion of the output rod 18 once the damaged surface area becomes even with the surround surface area. More specifically, the limit switch is positioned adjacent to the interchangeable magnetized base 27 and integrated into the piston rod 20 or the driving rod 22. When a bottom surface of the interchangeable magnetized base 27 aligns with the magnetized bottom rim 24, the limit switch automatically shuts off the compressed air flow or the electrical current flow to the respective control system 7 of the present invention, shutting down the linear actuator 13. As a result, the present invention is able to control the amount of pressure applied by the output rod 18 without further damaging the damaged surface area. Additionally, the user can activate or deactivate the limit switch upon user's discretion wherein the limit switch does not limit the functionality of the present invention.

Although the invention has been explained in relation to its preferred embodiment, it is to be understood that many other possible modifications and variations can be made without departing from the spirit and scope of the invention as hereinafter claimed.

What is claimed is:

1. A dent removing apparatus comprises:
- a handle;
- a linear actuator;
- an interchangeable suction cup;
- an interchangeable magnetized base;
- an actuator base of the linear actuator being internally connected to the handle;
- an output rod of the linear actuator being telescopically engaged to the actuator base and traversing through the handle;
- the interchangeable magnetized base being externally positioned to the handle;
- the interchangeable magnetized base being concentrically and terminally mounted to the output rod; and
- the interchangeable suction cup being externally connected to the handle and concentrically positioned around the interchangeable magnetized base.

2. The dent removing apparatus as claimed in claim 1 comprises:
- an inlet port;
- a control system;
- a directional switch;
- a control switch;
- the inlet port traversing into the handle;
- the control system being internally connected to the handle;
- the inlet port being operatively coupled to the control system;
- the directional switch and the control switch being integrated into the handle; and
- the directional switch and the control switch being operatively coupled to the actuator base through the control system.

3. The dent removing apparatus as claimed in claim 2 comprises:
- wherein the inlet port is an air inlet;
- the control system comprises a directional control valve and a flow control valve;
- the air inlet being in fluid communication with the directional control valve;
- the directional control valve being in fluid communication with the flow control valve;
- the flow control valve being in fluid communication with the actuator base;
- the directional switch being mechanically coupled to the directional control valve; and
- the control switch being mechanically coupled to the flow control valve.

4. The dent removing apparatus as claimed in claim 3 comprises:
- wherein the actuator base is a cylinder housing;
- the output rod comprises a piston and a piston rod;
- the piston being concentrically positioned to the piston rod;
- the piston being terminally connected to the piston rod;
- the piston being telescopically interfitted within the cylinder housing; and
- the piston rod traversing through the cylinder housing and the handle.

5. The dent removing apparatus as claimed in claim 3, wherein the air inlet is in fluid communication with an external air compressor unit through an air hose.

6. The dent removing apparatus as claimed in claim 2 comprises:
- wherein the inlet port is an electrical connector;
- the control system comprises a directional control solenoid and a flow control solenoid;
- the directional switch being electrically connected to the directional control solenoid and the electrical connector;
- the control switch being electrically connected to the flow control solenoid and the electrical connector; and
- the directional control solenoid and the flow control solenoid being electrically connected to the actuator base.

7. The dent removing apparatus as claimed in claim 6 comprises:
- the actuator base comprises a tubular housing and an in-line motor;
- the output rod comprises a spindle and a driving rod;
- the in-line motor being concentrically mounted within the tubular housing;
- the spindle being rotatably engaged to the in-line motor;
- the driving rod being concentrically engaged to the spindle, opposite of the in-line motor; and
- the driving rod traversing through the tubular housing and the handle.

8. The dent removing apparatus as claimed in claim 6, wherein the electrical connector is electrically connected to an external power supply unit through an extension cord.

9. The dent removing apparatus as claimed in claim 2 comprises:
- wherein the inlet port is an air inlet;
- the control system comprises a directional control solenoid, a flow control solenoid, and a power source;
- the air inlet being in fluid communication with the directional control solenoid;
- the directional control solenoid being in fluid communication with the flow control solenoid;
- the flow control solenoid being in fluid communication with the actuator base;

the directional switch being electrically connected to the directional control solenoid through the power source; and the control switch being electrically connected to the flow control solenoid through the power source.

10. The dent removing apparatus as claimed in claim 9 comprises:

wherein the actuator base is a cylinder housing;

the output rod comprises a piston and a piston rod;

the piston being concentrically positioned to the piston rod;

the piston being terminally connected to the piston rod;

the piston being telescopically interfitted within the cylinder housing; and the piston rod traversing through the cylinder housing and the handle.

11. The dent removing apparatus as claimed in claim 9, wherein the air inlet is in fluid communication with an external air compressor unit through an air hose.

12. The dent removing apparatus as claimed in claim 1 comprises:

the interchangeable suction cup comprises a magnetized bottom rim, a lateral wall, and an upper rim;

the upper rim being removably attached to the handle; and the magnetized bottom rim being oppositely positioned of the upper rim along the lateral wall.

13. The dent removing apparatus as claimed in claim 1, wherein a diameter of the interchangeable magnetized base being smaller than a diameter of the interchangeable suction cup.

* * * * *